US011780698B2

(12) United States Patent
Ueno et al.

(10) Patent No.: US 11,780,698 B2
(45) Date of Patent: Oct. 10, 2023

(54) MEDIUM PROCESSING DEVICE

(71) Applicant: SEIKO EPSON CORPORATION, Tokyo (JP)

(72) Inventors: Kohei Ueno, Matsumoto (JP); Nobuyuki Mizushima, Shiojiri (JP); Yutaro Harada, Shiojiri (JP); Shunpei Yamaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/659,251

(22) Filed: Apr. 14, 2022

(65) Prior Publication Data

US 2022/0234858 A1 Jul. 28, 2022

Related U.S. Application Data

(63) Continuation of application No. 16/693,922, filed on Nov. 25, 2019, now Pat. No. 11,345,561.

(30) Foreign Application Priority Data

Nov. 30, 2018 (JP) ..... 2018-225702

(51) Int. Cl.
*B65H 31/36* (2006.01)
*B65H 5/14* (2006.01)
(Continued)

(52) U.S. Cl.
CPC ..... *B65H 31/36* (2013.01); *B65H 5/068* (2013.01); *B65H 5/08* (2013.01); *B65H 5/14* (2013.01);
(Continued)

(58) Field of Classification Search
CPC ... B65H 5/08; B65H 5/14; B65H 5/32; B65H 9/004; B65H 9/12; B65H 29/003;
(Continued)

(56) References Cited

U.S. PATENT DOCUMENTS 8,408,540 B2 * 4/2013 Uchiyama ..... B65H 33/08 271/220
9,409,741 B2 8/2016 Osada et al.
(Continued)

FOREIGN PATENT DOCUMENTS

| | | |
|---|---|---|
| CN | 104724538 | 6/2015 |
| JP | 2003341918 | 12/2003 |
| JP | 2010-001149 | 1/2010 |

OTHER PUBLICATIONS

Merriam-Webster Dictionary, Sep. 27, 2022, pp. 1-5 attached (Year: 2022).*

*Primary Examiner* — Prasad V Gokhale
(74) *Attorney, Agent, or Firm* — WORKMAN NYDEGGER

(57) ABSTRACT

Provided is a medium processing device including a supply portion supplying a medium, a transporter transporting the medium supplied from the supply portion, an contact portion that a tip of the medium transported by the transporter is brought into contact with, a stacker in which the medium brought into contact with the contact portion is stacked, and a processor processing the medium stacked in the stacker, in which the transporter includes a gripper that is configured to move along a transport path of the medium, grips a tip of the medium, and moves.

9 Claims, 7 Drawing Sheets

(51) Int. Cl.

| | |
|---|---|
| ***B65H 5/06*** | (2006.01) |
| ***B65H 5/24*** | (2006.01) |
| ***B65H 7/02*** | (2006.01) |
| ***B65H 9/00*** | (2006.01) |
| ***B65H 29/02*** | (2006.01) |
| ***B65H 5/08*** | (2006.01) |

(52) U.S. Cl.
CPC ..... *B65H 5/24* (2013.01); *B65H 7/02* (2013.01); *B65H 9/004* (2013.01); *B65H 29/02* (2013.01); *B65H 2405/35* (2013.01)

(58) Field of Classification Search
CPC ..... B65H 29/02; B65H 29/10; B65H 31/02; B65H 31/36; B65H 2404/72; B65H 2405/1117; B65H 2405/11171; B65H 2405/11172; B65H 2405/35; B65H 2405/52
See application file for complete search history.

(56) References Cited

U.S. PATENT DOCUMENTS

| | | | | |
|---|---|---|---|---|
| 2004/0201165 | A1* | 10/2004 | Kamiya | B65H 31/36 271/220 |
| 2009/0212485 | A1* | 8/2009 | Shimizu | B65H 31/02 271/213 |
| 2015/0174941 | A1* | 6/2015 | Osada | B42C 9/0081 412/37 |
| 2015/0175379 | A1* | 6/2015 | Osada | B65H 45/18 270/58.08 |

* cited by examiner

MEDIUM PROCESSING DEVICE

The present application is a continuation of U.S. patent application Ser. No. 16/693,922, filed Nov. 25, 2019, which is based on, and claims priority from JP Application Serial Number 2018-225702, filed Nov. 30, 2018, the disclosures of which are hereby incorporated by reference herein in their entirety.

BACKGROUND

1. Technical Field

The present disclosure relates to a medium processing device processing a medium.

2. Related Art

In a medium processing device that performs predetermined processing on a medium, an end of a medium may be matched, that is aligned, with an end of another medium. A medium is basically aligned when the medium receiving a feeding force from a supply portion such as a feeding roller positioned upstream of a stacker of the medium in a transport direction slides along a path only by inertial force and gravity and a side of a lower end (tip) of the medium is brought into contact with an contact portion. Therefore, there is a problem that, depending on a state of the medium, the medium may be buckled and caught in the middle of a transport path and may fail to reach the contact portion. To resolve such a problem, a structure for facilitating the alignment of a medium is adopted in the related art (for example, JP-A-2010-001149).

JP-A-2010-001149 discloses a medium processing device having a structure in which a paddle provided with a wing is disposed on a lower side of a tray on which a medium is stacked and the paddle is rotated to bring the wing into sporadic contact with a surface of the medium so that the medium is moved to an contact portion positioned on a lower portion of the tray and is aligned.

However, in such a structure, since the paddle is positioned on the lower side of the tray, the medium may end up stagnating inside a transport path before reaching the paddle. Further, when the paddle is in an upper portion of the tray, the medium may end up bending in a case where circumferential speed of the wing generated by the rotation of the paddle is lower than the speed at which the feeding roller feeding the medium disposed upstream of the paddle feeds the medium. Therefore, there is a concern that the transport path of the medium to be fed next narrows and that the alignment is not possible. Further, when the circumferential speed of the wing by the rotation of the paddle is too high, the speed at which the medium is transported by the paddle may be too high and the lower end (tip) of the medium may bounce back when the medium is brought into contact with the contact portion, and alignment may not be possible.

SUMMARY

According to an aspect of the present disclosure, a medium processing device includes a supply portion supplying a medium, a transporter transporting the medium supplied from the supply portion, an contact portion with which a tip of the medium transported by the transporter is brought into contact, a stacker in which the medium brought into contact with the contact portion is stacked, and a processor processing the medium stacked in the stacker, in which the transporter includes a gripper that is configured to move along the transport path of the medium and that grips the tip of the medium and moves.

DESCRIPTION OF EXEMPLARY EMBODIMENTS

Figure 1:
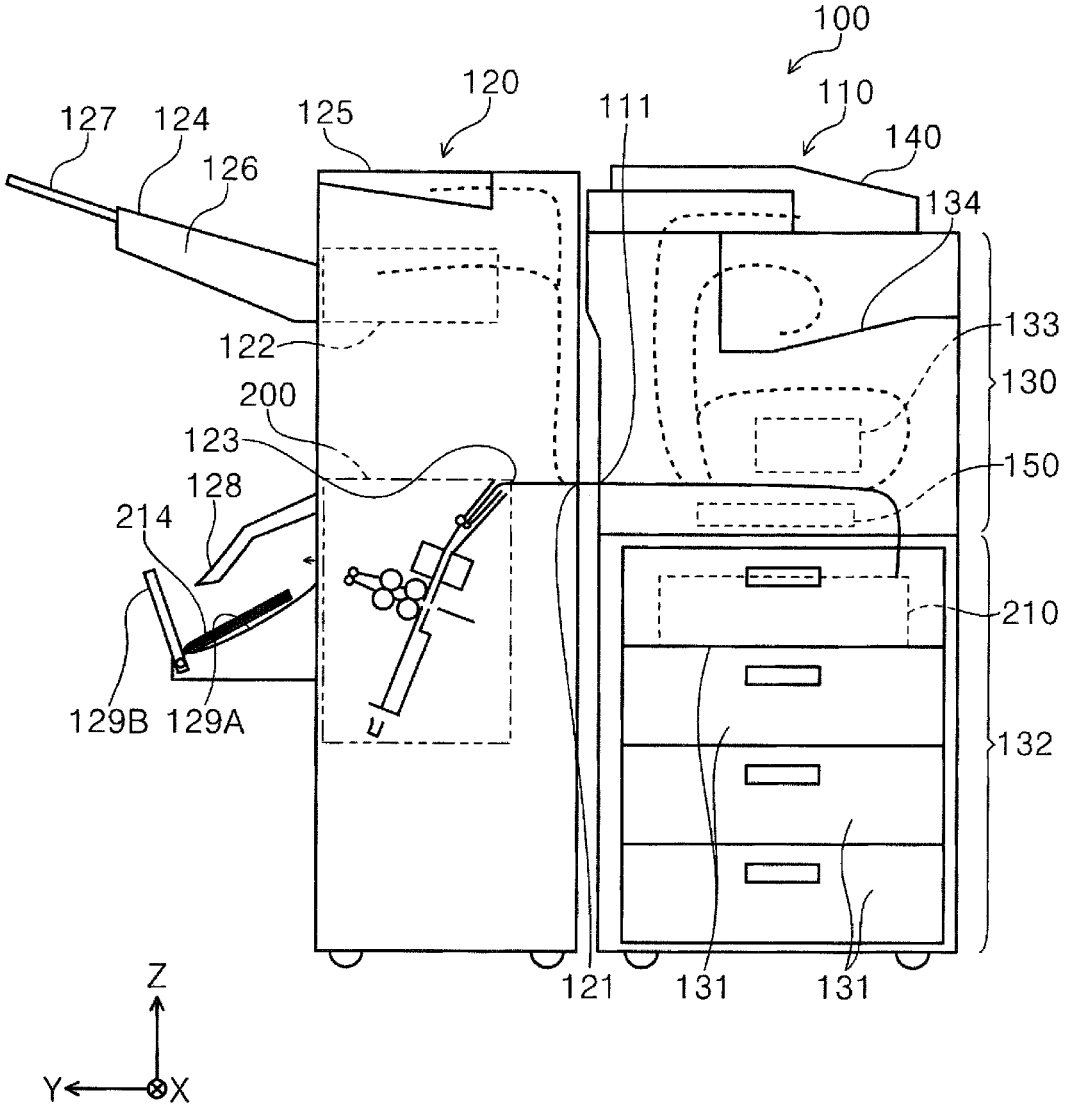
FIG. 1 is a schematic view of a recording system including a medium processing device.

First, the present disclosure will be schematically described.

A medium processing device according to a first aspect of the present disclosure includes a supply portion supplying a medium, a transporter transporting the medium supplied from the supply portion, an contact portion with which a tip of the medium transported by the transporter is brought into contact in a transport direction, a stacker in which the medium brought into contact with the contact portion is stacked, and a processor processing the medium stacked in the stacker, in which the transporter includes a gripper configured to move in the extending direction of the stacker to grip the tip of the medium and moves.

In this specification, the processing in "a processor processing the medium stacked in the stacker" is meant to include both processing performed at a position where the medium is stacked in the stacker and processing performed at a position where a bundle of medium which is stacked in the stacker and of which the tips are arranged is moved to the processor.

According to the present aspect, the transporter transports the medium supplied from the supply portion to the contact portion, with the gripper included in the transporter gripping the tip of the medium, and a tip side of the medium is brought into contact with the contact portion to be aligned. Then, the medium is stacked in the stacker in a state where the sides of the tips of the mediums are arranged to be aligned by contacting operation. That is, according to the present aspect, since the paddle in the related art is not used, it is possible to alleviate the concern that the medium supplied from the supply portion may stagnate in the middle of a transport path, to transport the medium to the contact portion more reliably than the one having the paddle structure of the related art to align, and to stack in the stacker.

According to a second aspect of the present disclosure, in the first aspect, the transporter grips the medium positioned in a range where a feeding force of the supply portion applies and moves the medium toward the contact portion.

In other words, the distance from the supply portion to a position where the transporter starts transport of the medium may be shorter than the length of the medium in a supply direction.

According to the present aspect, the transporter is configured to grip the medium positioned in a range where the feeding force of the supply portion applies and to move the medium toward the contact portion. In this way, since the transporter grips the medium and starts transport before the medium completely passes through the supply portion and does not receive the feeding force, it is possible to alleviate the concern that the medium may stagnate in the middle of the path.

According to a third aspect of the present disclosure, in the second aspect, in the processing in which the transporter transports the medium and stacks the medium in the stacker every time the medium is supplied from the supply portion, the region in which the transporter transports the medium does not overlap with the region in which the medium is stacked.

According to the present aspect, in the processing in which the transporter transports the medium and stacks the medium in the stacker every time the medium is supplied from the supply portion, the region in which the transporter transports the medium does not overlap with the region in which the medium is stacked. In this way, since the transporter can move the medium to the position where the medium is gripped without interfering with the medium already stacked in the stacker, the concern that the alignment state of the medium already stacked in the stacker may deteriorate is alleviated.

According to a fourth aspect of the present disclosure, in the third aspect, the stacker has a stacking surface on which the medium is stacked and the stacking surface is configured to move in the normal direction of the stacking surface.

According to a fifth aspect of the present disclosure, in the fourth aspect, a stacking surface is configured to move in accordance with the number of the mediums stacked in the stacker.

According to a sixth aspect of the present disclosure, in the second aspect, when the last medium is supplied from the supply portion, the transporter moves, together with the medium stacked in the stacker, to the range where the feeding force of the supply portion applies, grips, with the gripper, the entire medium to which the last medium is added, and moves toward the contact portion.

Here, "the last medium" means the medium supplies last among a plurality of mediums constituting a batch to be processed by the processor.

The stacker has a stacking space of a stacking height at which a plurality of mediums can be stacked. The medium fed from the supply portion is brought into contact with the contact portion and is stacked in the stacker. At this time, since there is no obstacle in the stacking space for the first sheet, it is possible to reach the contact portion by the inertial force based on the feeding force of the supply portion and the gravity of the medium. From the second sheet onward, the stacking space gradually dwindles caused by the presence of the medium already in the stacking position. Therefore, the medium supplied from the supply portion with no feeding force may stop midway and fails to reach the contact portion.

However, when the next medium is fed from the supply portion toward the contact portion, the feeding force on the next medium is also transmitted to the medium fed immediately before. That is, since it is possible to indirectly receive the feeding force pressed on the next medium, the medium which was fed immediately before and stopped midway can reach the contact portion.

However, since there is no indirect feeding force for the last sheet, the last sheet may not be able to reach the contact portion.

According to the present aspect, the transporter moves, together with the medium stacked in the stacker, to the range where the feeding force of the supply portion applies, grips the entire medium to which the last medium is added, and moves toward the contact portion. In this way, the last sheet can also reach the contact portion. That is, even when other medium is stacked in the stacker and the stacking space dwindles, it is possible to align the last sheet with the other medium.

According to a seventh aspect of the present disclosure, in any one of the first to sixth aspects, the processing performed by the processor includes saddle stitching processing in which a center of the medium in the transport direction is stitched in a state where the medium is stacked in the stacker with tips arranged and saddle folding processing in which the center of the medium is folded.

According to the present aspect, it is possible to effectively perform saddle stitching processing and saddle folding processing of the medium.

According to an eighth aspect of the present disclosure, in the seventh aspect, the medium stacked in the stacker is transported to the processor by the transporter and the processing is performed.

EMBODIMENTS

In the following, embodiments of the present disclosure will be described with reference to the drawings. The following description shows examples of the aspects of the present disclosure and the technical scope of the present disclosure is not narrowly limited in this way. As for the drawings, the same or equivalent elements or members are assigned the same reference numerals and repetitive descriptions will be omitted.

Outline of Recording System

A recording system 100 shown in FIG. 1 includes, from right to left in FIG. 1 for example, a recording unit 110 and a processing unit 120 including a medium processing device 200.

The recording system 100 is configured such that a setting can be input into the recording unit 110 and the processing unit 120 from an operation panel (not shown). The operation panel can be provided in the recording unit 110, for example.

In the present embodiment, the medium 210 is a cut paper sheet and is a rectangular sheet-shaped body having sides of predetermined lengths, for example. A material of the medium 210 is flexible, and it is possible to record on the surface of the medium 210 by the recording unit 110. A material characteristic of the medium 210 is a paper sheet, for example, and is not limited thereto.

The recording unit 110 records on the transported medium 210. The processing unit 120 performs predetermined processing such as stapling processing on the medium 210 after recording in the recording unit 110. In the following, the recording unit 110 and the processing unit 120 will be described.

The recording unit 110 is configured as a multifunctional machine including a printer section 130 recording on the medium 210 and a scanner section 140. In the present embodiment, the recording method in the printer section 130 is a so-called ink jet recording in which liquid ink is ejected on the medium 210 to record.

A cassette storage unit 132 including a plurality of medium storage cassettes 131 is provided below the printer section 130. The medium 210 stored in the medium storage cassette 131 is fed to the recording region 133 and the recording operation is performed. The medium 210 after recording is fed to a post-recording discharge tray 135.

The recording unit 110 is provided with a controller 150 controlling an operation related to transport and recording of the medium 210 in the recording unit 110. The recording system 100 is configured such that the recording unit 110 and the processing unit 120 are coupled to each other and the medium 210 is transported from the recording unit 110 to the processing unit 120. The controller 150 can control various operations in the processing unit 120 coupled to the recording unit 110.

The recording system 100 is configured such that a setting can be input into the recording unit 110 and the processing unit 120 from an operation panel (not shown). The operation panel can be provided in the recording unit 110, for example.

Next, an outline of the processing unit 120 will be described with reference to FIG. 1.

The processing unit 120 includes a first receiver 121 receiving the medium, a first processor 122 performing a first processing on the medium received from the first receiver 121, a feeder 123 feeding the medium 210 received from the first receiver 121 to the medium processing device 200 through the first processor 122, and a processing unit housing 125 including the medium processing device 200.

A first tray 124 receiving the medium discharged from the processing unit housing 125 after the first processing is provided outside the processing unit housing 125. The first tray 124 is provided to protrude from the processing unit housing 125 which constitutes the appearance of the processing unit 120. In the present embodiment, the first tray 124 includes a base 126 and an extender 127 and the extender 127 is configured to be stored in the base 126.

First Embodiment

On Medium Processing Device

The medium processing device 200 according to a first embodiment will be described with reference to FIG. 2.

The medium processing device 200 includes a supply portion 220 supplying a medium 210, a transporter 230 transporting the medium 210 supplied from the supply portion 220 in a transport direction T, an contact portion 240 with which a tip 211 of the medium 210 transported by the transporter 230 is brought into contact, a stacker 250 in which the medium 210 brought into contact with the contact portion 240 is stacked, and a processor 260 processing the medium 210 stacked in the stacker 250.

The medium 210 fed from the feeder 123 of the processing unit 120 is fed to the supply portion 220 through the supply surface 222 of the medium processing device 200. A pair of supply rollers 221 is disposed in the supply portion 220 and the medium 210 is fed by the pair of supply rollers 221 in the transport direction T(+).

Figure 3:
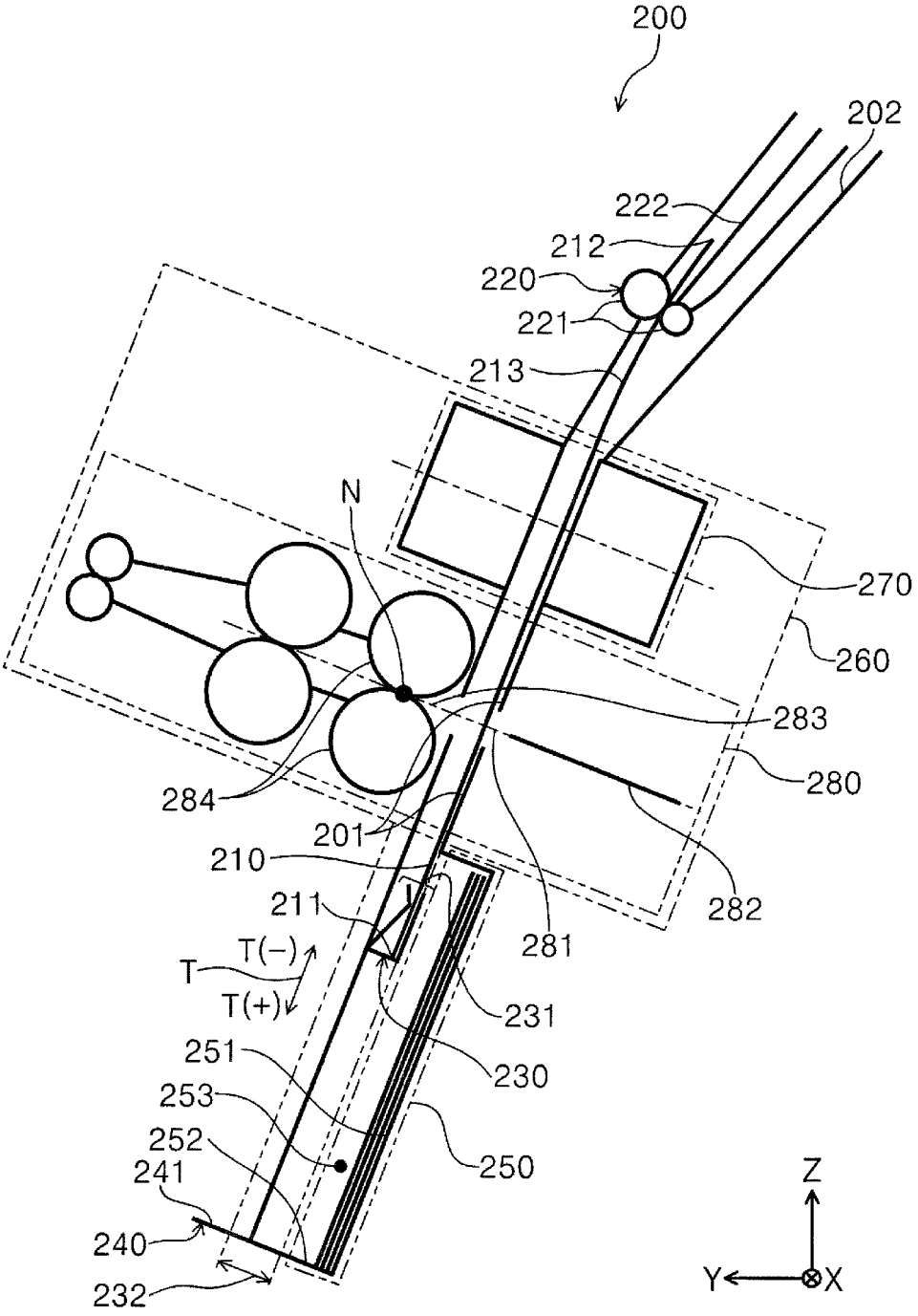
FIG. 3 is a schematic sectional view of a medium processing device according to the first embodiment in a state where a transporter is in a position to start transport of a medium supplied from a supply portion.
Figure 4:
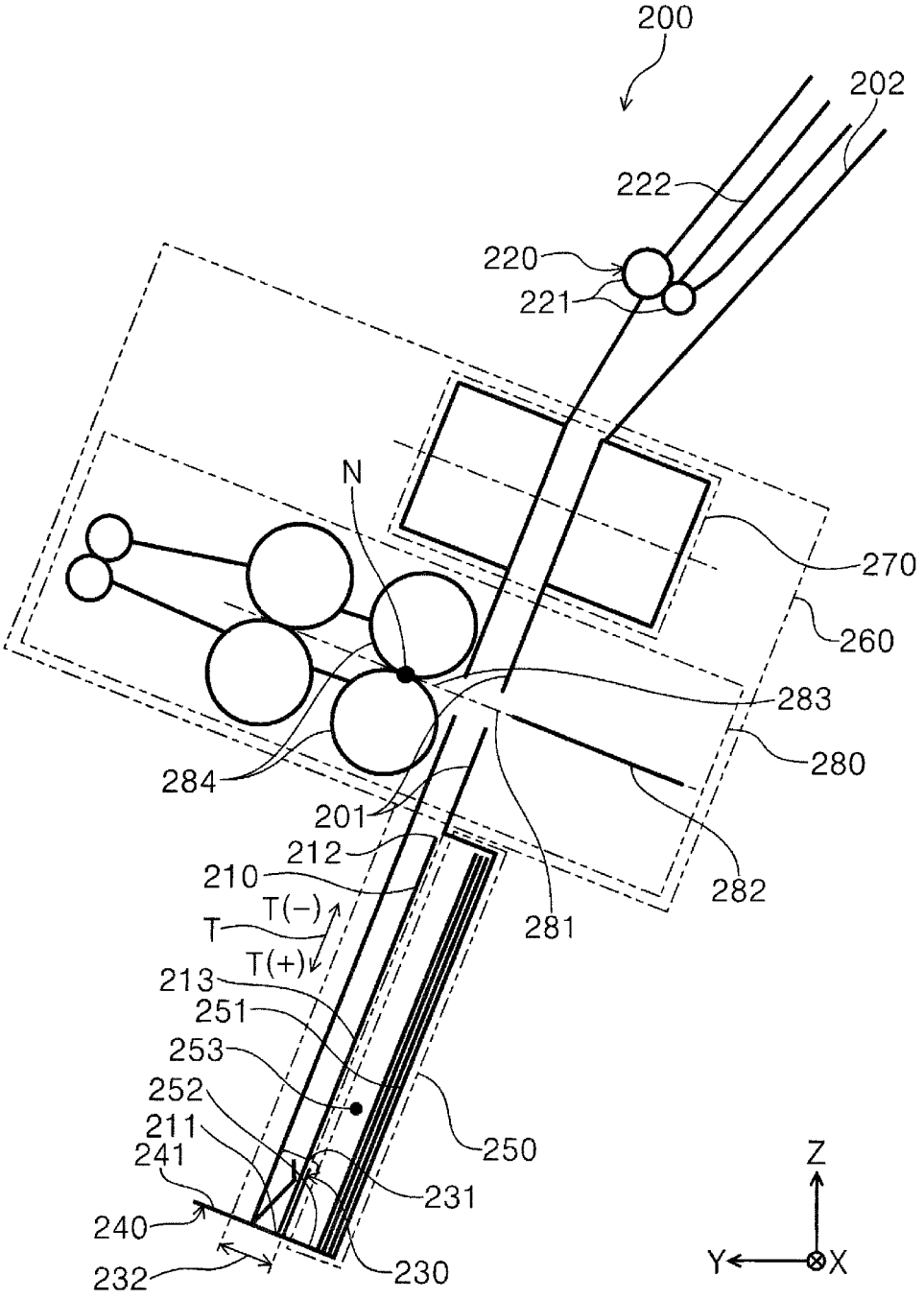
FIG. 4 is a schematic sectional view of a medium processing device according to the first embodiment in a state where a transporter is in a position to bring a medium into contact with a contact portion.

When the medium 210 fed from the supply portion 220 enters a transport path 201 and reaches the transport start position of the transport path 201, a tip 211 of the medium 210 is gripped by a moving gripper 231 of the transporter 230 as shown in FIG. 3. Then, the transporter 230 transports, in the transport direction T(+), the tip 211 of the medium 210 in a state of being gripped by the gripper 231 to bring the tip 211 into contact with the contact portion 240. The medium 210 transported by the transporter 230 to the stacker 250 direction T(+) is released from the gripping state of the gripper 231 as the tip 211 of the medium 210 is brought into contact with the abutting surface 241 of the contact portion 240 as shown in FIG. 4.

Thereafter, the medium 210 is stacked in the stacker 250 in alignment with the position of the tips of other mediums. After a predetermined number of mediums 210 are stacked in the stacker 250, the medium 210 stacked in the stacker 250 is transported by the transporter 230 in the processor 260 direction T(−) and predetermined processing is performed by the processor 260.

The medium 210 after predetermined processing is discharged to a second tray 129A. The second tray 129A includes a restrictor 129B at a tip portion in the medium discharge direction, restricting a medium bundle discharged to the second tray 129A from sticking out from the second tray 129A in the medium discharge direction or falling off from the second tray 129A. Reference numeral 128 denotes a guide portion 128 guiding the medium 210 discharged from the processing unit housing 125 to the second tray 129A.

On Supply Portion

The supply portion 220 in the present embodiment will be described with reference to FIG. 2.

The supply portion 220 plays a role of feeding the medium 210 fed from other parts of the processing unit 120 into the medium processing device 200. Accordingly, it is sufficient if the medium 210 can be fed into the medium processing device 200, and the specific structure is not limited to the following description.

In the first embodiment, the supply portion 220 is configured with a pair of supply rollers 221 and a supply surface 222. The pair of supply rollers 221 is configured such that one is a driving roller and the other is a driven roller and the driving roller of the pair of supply rollers 221 is disposed to contact with and nip the medium 210 on the same surface as the supply surface 222.

On Stacker

The stacker 250 in the present embodiment will be described with reference to FIG. 2.

The stacker 250 plays a role of sequentially stacking the medium 210 which is transported by the transporter 230 in the transport direction T(+) and of which the tip 211 is brought into contact with the contact portion 240. The stacker 250 is configured such that the medium 210 brought into contact with the contact portion 240 is stacked without generating positional deviation in the direction T along the surface thereof.

The stacker 250 is configured with a stacking surface 251 on which the rear surface of the medium 210 is stacked and a defining plate 252 defining the downstream T(+) position of the stacked medium 210 in the transport direction T. Further, the stacker 250 may have a side defining plate 253 defining the side surface position of the stacked medium 210 in the direction orthogonal to the transport direction T among the two-dimension directions of the surface. The stacker 250 may have a structure restricting the movement of the medium 210 in the stacked state in the direction orthogonal to the transport direction T.

Figure 5:
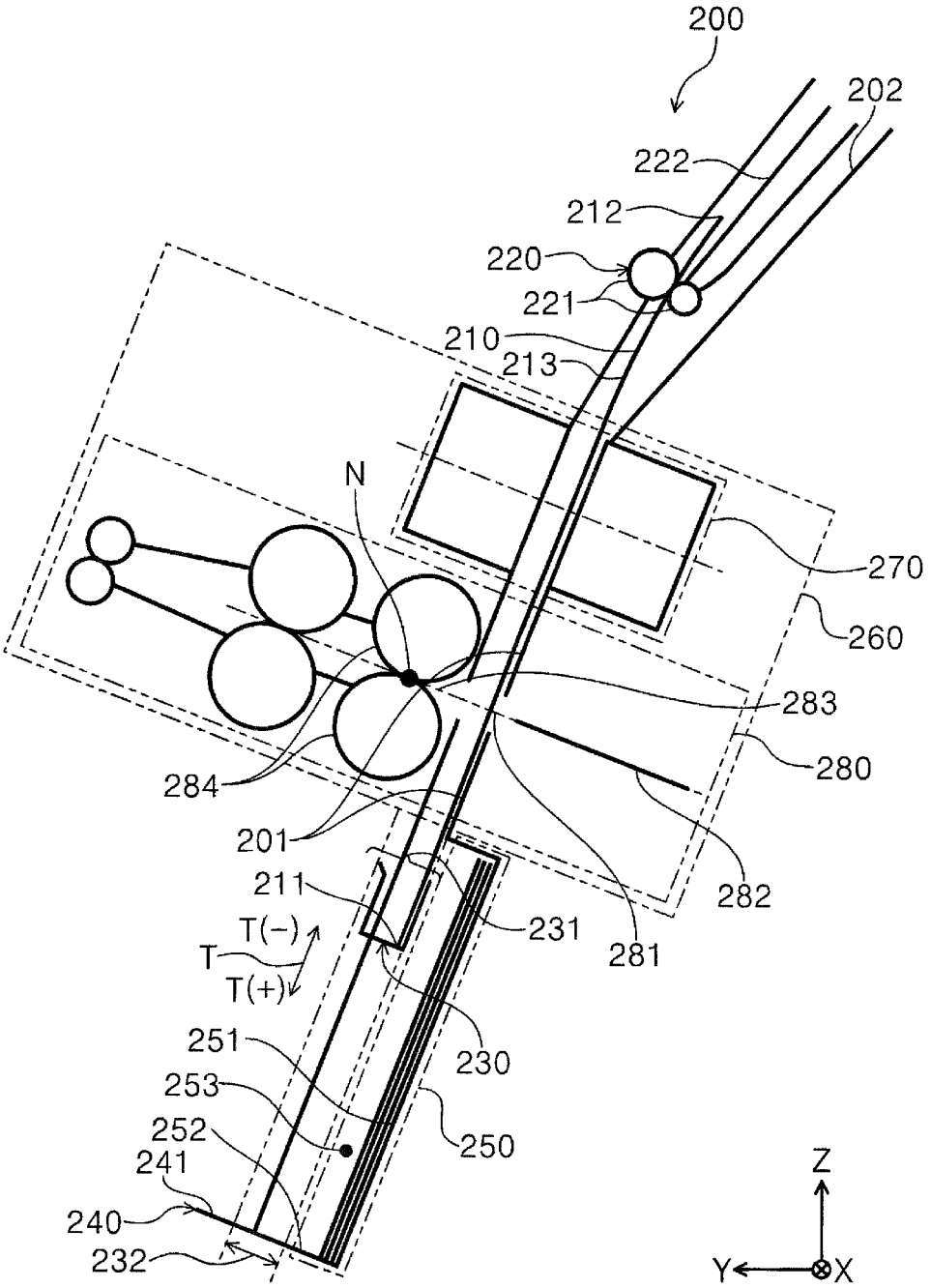
FIG. 5 is a schematic view of a medium processing device according to the first embodiment showing positional relationship between a track of a medium stacked in a stacker and a track of a medium transported by the transporter.

In the present embodiment, as shown in FIGS. 3 to 5, the transporter 230 may be configured to move to the transport start position for each sheet of the medium 210 and to grip the tip 211 with the gripper 231 to carry the tip 211 to the contact portion 240. Therefore, in order to make possible the move of the transporter 230 to the transport start position in a state where the medium 210 is stacked on the stacking surface 251, the stacker 250 is configured such that the stacked medium 210 is positioned away (retreats) from the transport region 232 in which the transporter 230 moves. That is, as shown in FIG. 2, the stacking surface 251 is provided at a position separated from the transport region 232.

Further, in the present embodiment, the stacker 250 is configured such that the stacking surface 251 can move in the normal direction of the stacking surface 251. By this movement in the normal direction, the bundle of a predetermined number of mediums 210 aligned and stacked in the stacker 250 can be positioned on the moving path to the processor 260. In this way, it is possible to move the bundle of media 210 to the processor 260 by the transporter 230.

The stacking surface 251 has a surface of a size larger than the size of the surface of the medium 210. It is desirable that the stacking surface 251 is a flat and smooth surface having low frictional resistance against the medium 210 in the transport direction T. The stacking surface 251 may have a rib structure that does not interfere with the move in the transport direction T. Now that the stacking surface 251 has a rib structure, the medium 210 can avoid sticking to the stacking surface 251.

The stacking surface 251 may be enabled to change the stacking height of the medium 210 stacked in the stacker 250 as the number of mediums stacked in the stacker 250 increases. In this way, it is possible to avoid dwindling of the stacking space in the stacker 250 caused by the medium 210 transported by the transporter 230.

The defining plate 252 plays a role of defining the position of the tip 211 of the medium 210 stacked on the stacking surface 251 in the transport direction T among the directions along the surface thereof. The defining plate 252 is provided at the lower end position of the stacker 250 and the height of the defining plate 252 with respect to the stacking surface 251 is at least equal to or higher than the thickness of the medium 210 stacked in the stacker 250. The surface of the defining plate 252 with which the tip 211 of the medium 210 contacts is a smooth surface.

The side defining plate 253 plays a role of defining the side surface position of the medium 210 stacked on the stacking surface 251 in the direction orthogonal to the transport direction T among the two-dimension directions of the surface. The side defining plate 253 is provided at a position where the medium 210 stacked in the stacker 250 contacts with the side end portion of the stacking surface 251 in the direction orthogonal to the transport direction T. Further, the side defining plate 253 may be configured to move the position in accordance with the size of the medium 210 in the direction orthogonal to the transport direction T. The side defining plate 253 may be structured to move in the transport direction T and move together with the transporter 230.

In the first embodiment, the stacking surface 251 of the stacker 250 is provided to be inclined such that the transport direction T(+) is downward. The defining plate 252 and the side defining plate 253 are also provided to be inclined in accordance with the inclination of the stacking surface 251. Further, the defining plate 252 is provided on the same surface as the contact portion 240 to be described below.

The medium 210 brought into contact with the contact portion 240 by the transporter 230 moves in parallel toward the stacking surface 251 while contacting with the defining plate 252 and the side defining plate 253 and is stacked. In this way, after being brought into contact with the contact portion 240, the medium 210 is stacked without generating positional deviation in the direction along the surface of the medium 210. That is, the medium 210 is stacked in an aligned state with another medium 210 stacked in the stacker 250.

On Contact Portion

The contact portion 240 in the present embodiment will be described with reference to FIG. 2.

Figure 2:
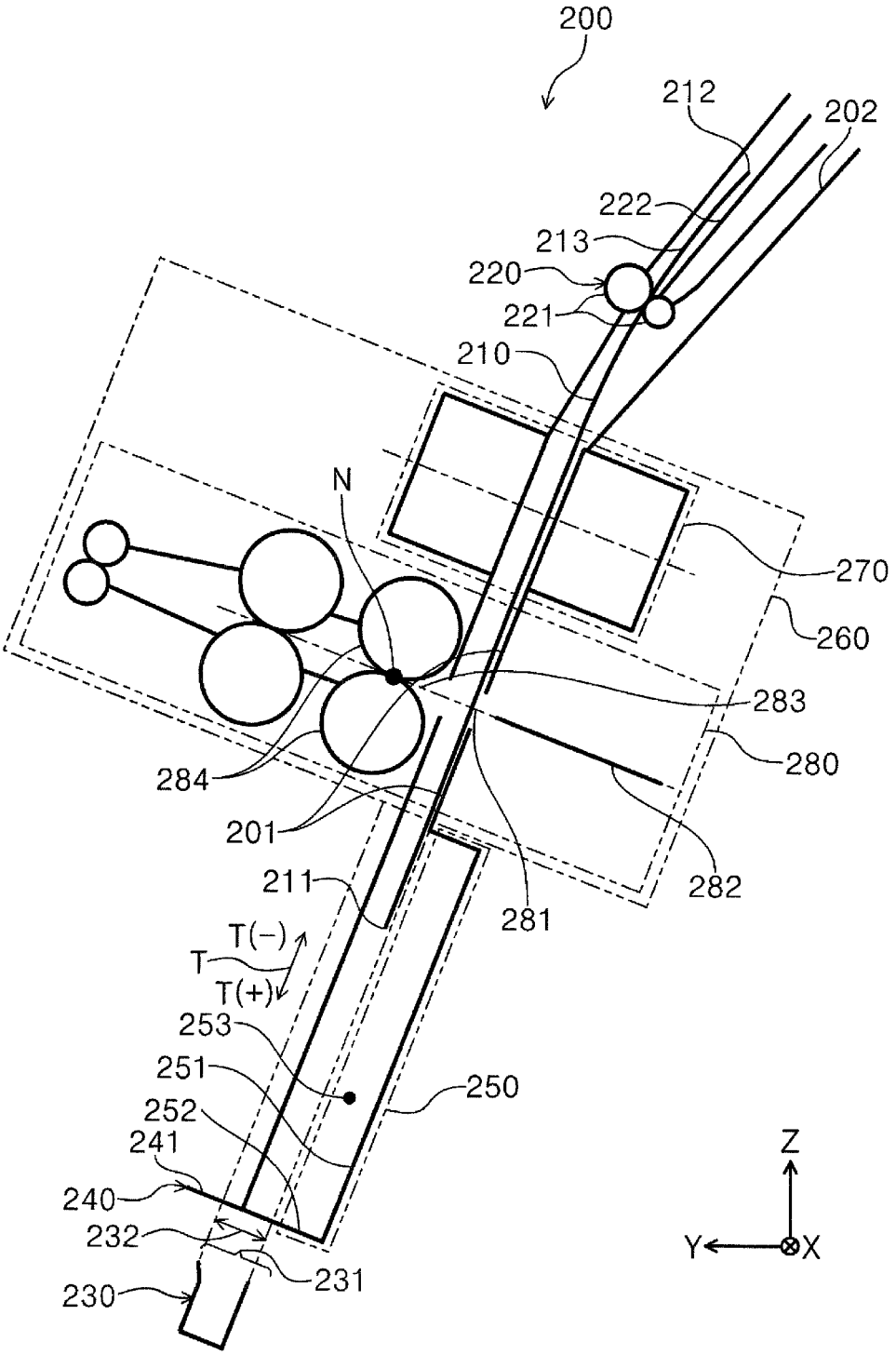
FIG. 2 is a schematic sectional view of a medium processing device according to a first embodiment in a state where a transporter is in a standby position.

As shown in FIG. 2, the contact portion 240 is provided at the lower end of the stacker 250. The contact portion 240 plays the role of a target with which the tip 211 of the medium 210 transported by the transporter 230 is brought into contact.

The tip 211 of the medium 210 is brought into contact with the contact portion 240 and the medium 210 released from the transporter 230 is stacked in the stacker 250. That is, the contact portion 240 serves as a positional reference for aligning the tip 211 of the medium 210 with the tip 211 of another medium 210. The contact portion 240 is positioned at the lower end of the stacker 250 and is positioned on the transport path 201 of the medium 210 transported by the transporter 230. The contact portion 240 includes a surface with which the tip 211 of the medium 210 is brought into contact and has a slit structure through which the transporter 230 can pass. Specifically, the contact portion 240 is configured with a plate-shaped body in which a slit is formed. The contact portion 240 may be structured into a plurality of divisions.

In the first embodiment, the contact portion 240 is positioned at the lower end of the stacker 250 having an inclination and is positioned on the transport region 232 of the transporter 230. The height of the contact portion 240 with respect to the stacking surface 251 is at least the height at which the medium 210 transported by the transporter 230 is brought into contact with the contact portion 240. The stacking surface 251 of the stacker 250 and the defining plate 252 are integrally formed and the surface of the contact portion 240 with which the tip 211 of the medium 210 is brought into contact is formed of a flat smooth surface like the defining plate 252.

The medium 210 transported by the transporter 230 moves in parallel along the defining plate 252 toward the stacking surface 251 after the tip 211 of the medium 210 is brought into contact with the contact portion 240 and is stacked. Further, since the portion of the contact portion 240 through which the transporter 230 passes in the transport direction T has a slit structure, the transporter 230 can pass through the contact portion 240.

On Transporter

The transporter 230 in the present embodiment will be described with reference to FIG. 2.

As described above, the transporter 230 plays a role of transporting to the contact portion 240 the medium 210 supplied from the supply portion 220 and transporting the medium 210 stacked in the stacker 250 to the processor 260. That is, the transporter 230 grips the tip 211 of the medium 210 supplied from the supply portion 220 with a gripper 231, transports the medium 210 in the transport direction T(+) to bring the medium 210 into contact with the contact portion 240, and transport the medium 210, stacked in the stacker 250 and bundled, toward the processor 260 in the transport direction T(−).

In the first embodiment, based on an instruction from the controller 150, the transporter 230 transports the medium 210 supplied from the supply portion 220, gripping the tip 211 of the medium 210 with the gripper 231.

Further, the force with which the gripper 231 of the transporter 230 grips the medium 210 is weak enough to release the medium 210 from the grip of the transporter 230 when the transporter 230 brings the medium 210 into contact with the contact portion 240 in a state where the tip 211 of the medium 210 is gripped. In this way, the transporter 230 can bring the transported medium 210 into contact with the contact portion 240 only by moving in the transport direction T(+). Of course, the force with which the gripper 231 grips the medium 210 may be configured such that the medium 210 is gripped more strongly and firmly and the grip is released when the medium is carried to the position of the contact portion 240.

On Transport Start Position

The transport start position at which the transporter 230 starts transport of the medium 210 supplied from the supply portion 220 will be described with reference to FIG. 3.

The transport start position is a position at which the transporter 230 starts transport of the medium 210 supplied from the supply portion 220. When the gripper 231 of the transporter 230 grips the tip 211 of the medium 210 to transport, the distance from the supply portion 220 to the transport start position is shorter than the length of a side of the medium 210 in the transport direction T. In this way, at the transport start position, a rear end 212 of the medium 210 is at a position where the feeding force can be received from the supply portion 220. Therefore, at the transport start position, the medium 210 receives the feeding force from the supply portion 220.

By the start of the transport at the transport start position, the medium 210 can receive at least one of the feed force from the pair of supply rollers 221 of the supply portion 220 and the transport force by the transporter 230. In this way, a state in which no external force applies to the medium 210 does not arise, so that the medium 210 does not stagnate inside the transport path 201. That is, the tip 211 of the medium 210 can be reliably brought into contact with the contact portion 240 by the transporter 230.

The transport start position is basically a position at which the medium 210 receives the feeding force from the supply portion 220 but may be immediately after the rear end 212 of the medium 210 is discharged from the supply portion 220.

Second Embodiment

Figure 6:
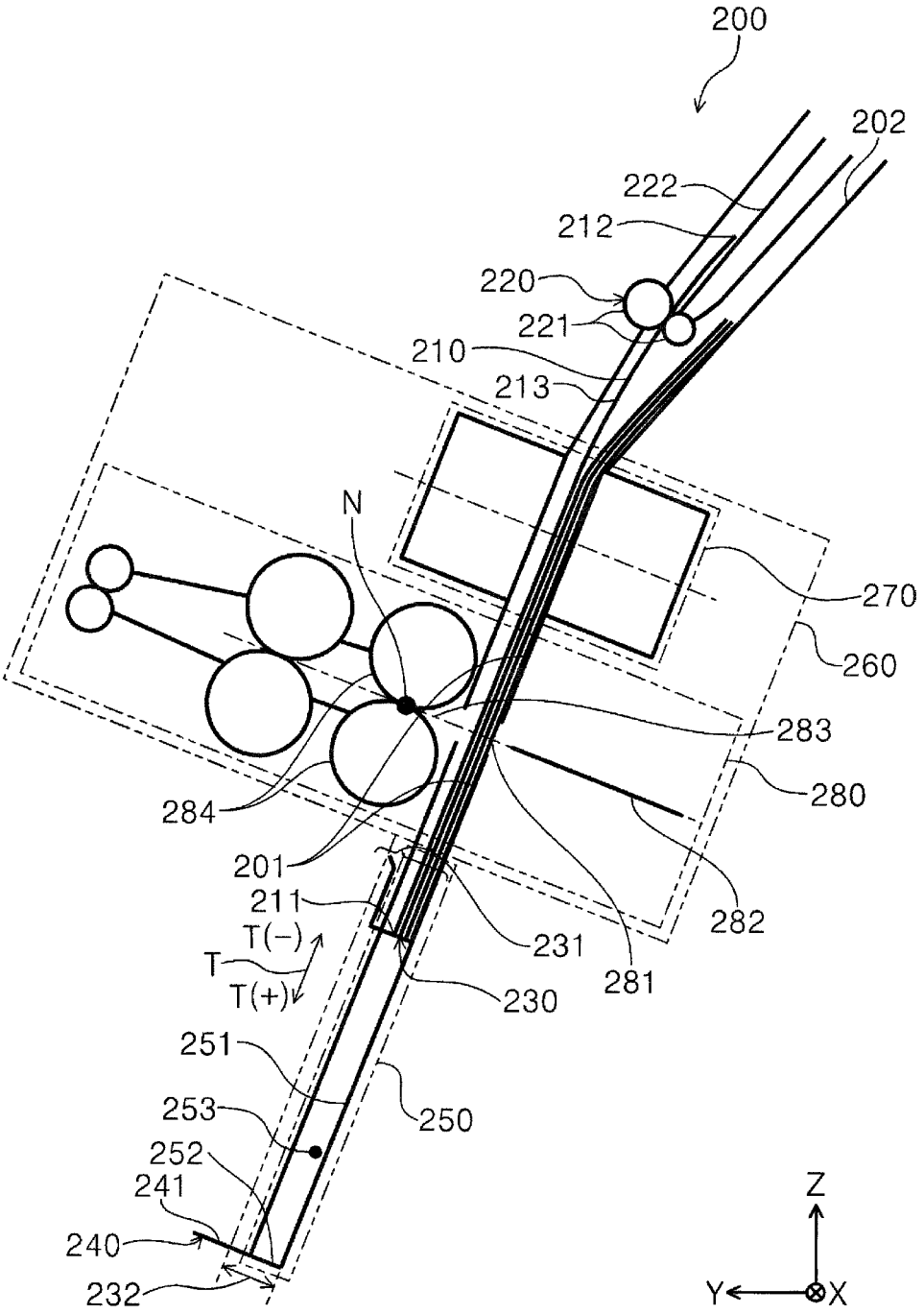
FIG. 6 is a schematic view of a medium processing device according to a second embodiment in a position to start transport of a medium supplied from a supply portion.

A medium processing device 200 according to a second embodiment of the present disclosure will be described with reference to FIG. 6.

In the first embodiment, the transporter 230 is configured to move to the transport start position for each sheet of the medium 210 and grip the tip 211 by the gripper 231 to carry the tip 211 to the contact portion 240. However, depending on conditions such as the structure of the stacking space of the stacker 250, the type of the medium 210, and the like, only the last one among the predetermined number of the mediums 210 may be gripped by the transporter 230 and transported to the contact portion 240. The case will be described next.

That is, the stacker 250 has a stacking space of a stacking height in which a plurality of mediums 210 can be stacked. The medium 210 fed from the supply portion 220 is brought into contact with the contact portion 240 and is stacked in the stacker 250. At this time, since there is no obstacle in the stacking space for the first sheet, it is possible to reach the contact portion 240 by the inertial force based on the feeding force of the supply portion 220 and the gravity of the medium 210. From the second sheet onward, the stacking space gradually dwindles caused by the presence of the medium 210 already in the stacking position. Therefore, the medium 210 supplied from the supply portion 220 with no feeding force may stop midway and fails to reach the contact portion 240.

However, when the next medium 210 is fed from the supply portion 220 toward the contact portion 240, the feeding force from the supply portion 220 on the next medium 210 is also transmitted to the medium 210 fed immediately before. That is, since it is possible to indirectly receive the feeding force pressed on the next medium 210, the medium 210 which was fed immediately before and stopped midway can reach the contact portion 240.

However, since there is no indirect feeding force for the last sheet of medium 210, the last sheet may not be to reach the contact portion 240.

In the present embodiment, when the last sheet of medium 210 is supplied from the supply portion 220, the transporter 230 is configured to move, together with the medium 210 stacked in the stacker 250, to the range where the feeding force of the supply portion 220 applies, grip the entire medium to which the last sheet of medium 210 is added with the gripper 231, and move toward the contact portion 240. In this structure, the stacking surface 251 does not retreat as in the first embodiment. The bundle of medium 210 stacked on the stacking surface 251 is positioned inside the transport region 232 of the transporter 230.

Here, the "last medium" means the medium 210 supplied last among the plurality of mediums 210 forming a batch to be processed by the processor 260.

Though partially repetitive, specific description will follow.

First, when the last sheet of medium 210 is supplied from the supply portion 220, the tip 211 of the bundle of the medium 210 stacked in the stacker 250 is gripped by the gripper 231 of the transporter 230. The bundle of medium 210 is transported toward the supply portion 220 by the transporter 230 and stops at the transport start position, and the transporter 230 releases the gripper 231. At this time, the rear end 212 (upper end) of the medium 210 retreats to a retreat path 202.

Next, when the last medium 210 is supplied from the supply portion 220 and the tip 211 thereof reaches the region of the gripper 231 of the transporter 230, the respective tips of the last sheet of medium 210 and the bundle of medium are collectively gripped by the gripper 231. At this time, the gripper 231 has a function of the contact portion 240 and may align the last sheet, once brought into contact, with the tip (lower end) of another medium 210. Thereafter, the transporter 230 transports the entire medium 210 toward the contact portion 240 brings the tip 211 of the entire medium 210 into contact with the contact portion 240. In this way, the medium 210 is aligned and stacked in the stacker 250. Here, the side defining plate 253 may move together with the transporter 230.

According to the present embodiment, the transporter 230 moves, together with the medium 210 stacked in the stacker 250, to the range where the feeding force of the supply portion 220 applies, grips the entire medium 210 to which the last medium 210 is added, and moves toward the contact portion 240. In this way, the last sheet can also reach the contact portion 240. That is, even when the other medium 210 is stacked in the stacker 250 and the stacking space dwindles, it is possible to align the last sheet with the other medium 210.

On Processor

The processor 260 performs stitching processing by a stitcher 270 stitching the medium 210 and folding processing by a folder 280 saddle-folding the medium 210. The processed medium 210 is discharged to the second tray 129A of the processing unit 120.

The processor 260 will be described in further detail with reference to FIGS. 1 and 2.

The processor 260 includes the stitcher 270 stitching a plurality of mediums 210 stacked in the stacker 250 and the folder 280 folding the medium 210. The processor 260 is provided between the supply portion 220 and the stacker 250 in the transport direction T(+) of the supply portion 220.

The stitcher 270 is provided on the transport path 201 in the transport direction T(+) of the supply portion 220. An example of the stitcher 270 is a stapler. In the present embodiment, a plurality of stitchers 270 are provided at intervals in the direction orthogonal to the transport direction T of the medium 210. The stitcher 270 is configured to stitch the medium 210 at the center of the medium 210. The stitching position by the stitcher 270 in the present embodiment is a central portion of the bundle of the medium 210, aligned in the stacker, in the transport direction T.

The folder 280 is provided adjacent to the stitcher 270 in the transport direction T(+). The folder 280 includes a pair of folding rollers 283 and a blade 282 nipping the medium 210 at the stitching position with the pair of folding rollers 283. Reference numeral 281 denotes a folding hole, formed through the stacking surface 251, through which the blade 282 advances and retreats.

The folder 280 is provided with a pair of folding rollers 283 on the surface facing the transport path 201, and an approach path 284 is formed between the transport path 201 and a nipping position N of the pair of folding rollers 283. A slope (not shown) may be formed at the entrance to the approach path 284 to guide the stitching position from the stacker 250 to the nipping position N.

The stitching processing and the folding processing in the processor 260 will be described below. Here, the case where the central portion of the medium 210 is stitched by the stitching processing and then the central portion of the medium 210 is folded by the folding processing is presented.

After a predetermined number of mediums 210 are stacked in the stacker 250, the bundle of medium 210 stacked in the stacker 250 is transported in the direction T(−) of the supply portion 220 by the transporter 230 based on an instruction from the controller 150. The bundle of medium 210 comes to a position where the central portion of the medium 210 overlaps with the stitching position of the stitcher 270, the transporter 230 stops transport, and the stitching processing is performed by the stitcher 270. Here, the rear end 212 of the medium 210 transported by the transporter 230 retreats to the retreat path 202 (refer to FIG. 6).

Subsequently, the bundle of medium 210 subjected to stitching processing by the stitcher 270 is moved by the transporter 230 in the direction T(+) of the stacker 250. When the central portion of the bundle of medium 210 reaches a position (folding hole 281) where the blade 282 passes through the transport path 201, the transport is stopped. Next, the blade 282 is advanced to the folding hole 281. In this way, when the position of the medium 210 subjected to the stitching processing by the stitcher is nipped by the pair of folding rollers 283, the medium 210 is folded by the rotation of the pair of folding rollers 283 into a booklet 215 and is discharged toward the second tray 129A. A plurality of folding roller pairs 283 may be provided. When a plurality of folding roller pairs 283 are provided, it is possible to reliably perform folding processing.

The medium processing device 200 can be provided with a crease forming mechanism forming a crease at the stitching position of the medium 210 on the transport path 201. Since the stitching position is the folding position by the pair of folding rollers 283, it is possible to easily fold the medium 210 at the stitching position by adding a crease to the stitching position.

In the present embodiment, the processing performed by the processor 260 may include at least one of the stitcher 270 stitching the medium 210 stacked in the stacker 250 and the folder 280 folding the medium 210 at the center. The processor 260 may perform stitching processing of stitching the ends of the medium 210 with a stapler or may perform punching processing of boring holes at predetermined positions of the medium.

Third Embodiment

Figure 7:
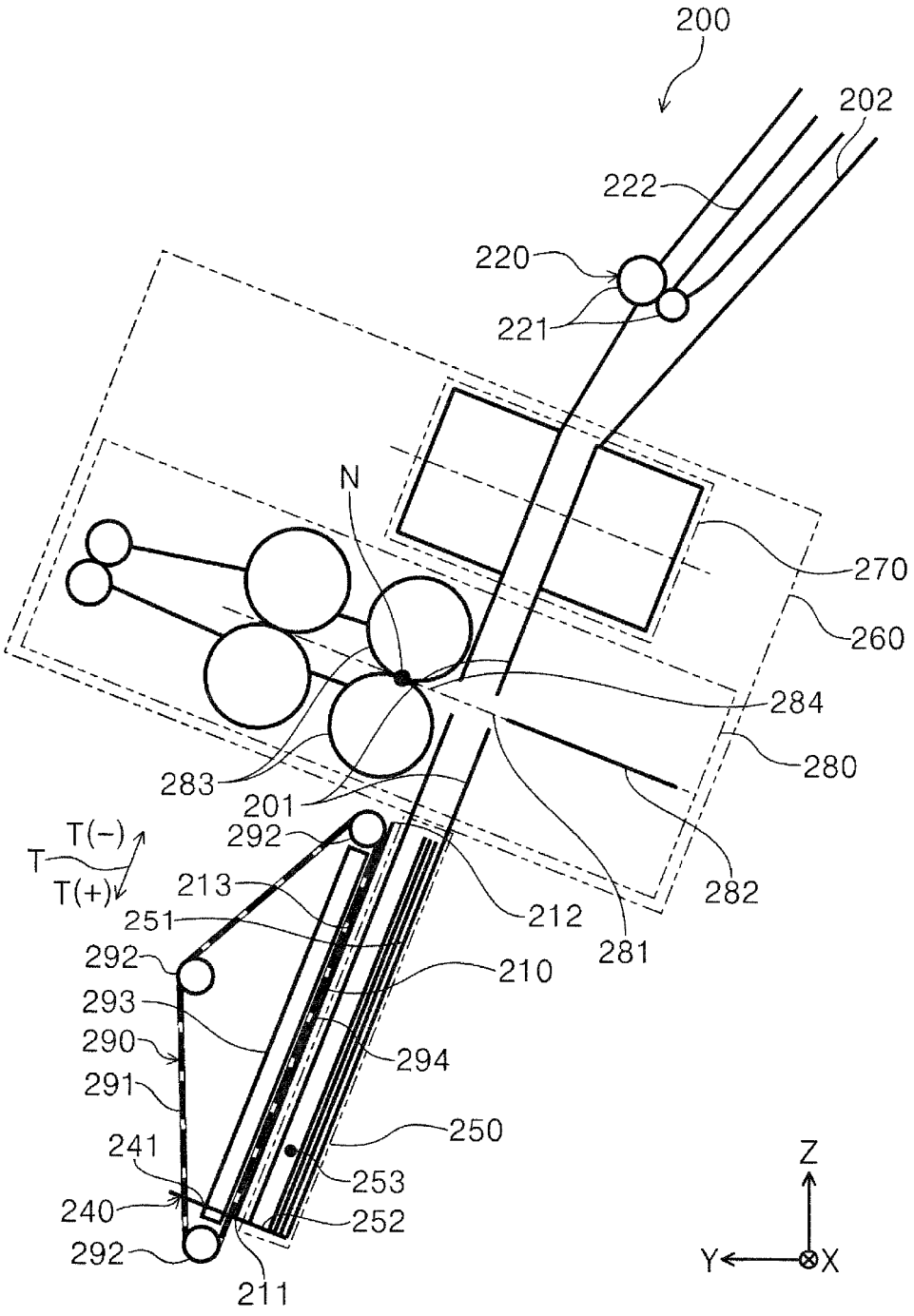
FIG. 7 is a schematic view of a medium processing device according to a third embodiment in a position to start transport of a medium by a belt transporter.

A medium processing device 200 according to a third embodiment of the present disclosure will be described with reference to FIG. 7.

Belt Transporter

In the present embodiment, the medium 210 is adsorbed and transported by the belt transporter 290 instead of being transported by the transporter 230 in the first embodiment.

Also in the present embodiment, it is possible to transport the medium 210 to the contact portion 240 by adsorbing and holding the surface 213 of the medium 210 with the belt transporter 290. That is, it is possible to align the medium 210 with another medium.

The belt transporter 290 of the present embodiment will be described.

The belt transporter 290 is configured with a loop belt 291 formed in an annular shape, three belt rollers 292 disposed inside the ring of the loop belt 291 to pull the loop belt 291, and a suction chamber 293 sucking by negative pressure. The loop belt 291 is provided with holes 294 for causing the negative pressure from the suction chamber 293 to communicate to the surface side of the loop belt 291. The belt transporter 290 is positioned between the supply portion 220 and the stacker 250, and the suction chamber 293 and the holes 294 are disposed in parallel to the stacking surface 251.

The belt rollers 292 can be rotated forward and backward by a driving force (not shown) based on an instruction from the controller 150, and the loop belt 291 is driven. In this way, it is possible to move the holes 294 provided in the loop belt 291 toward the transporter or toward the supply portion 220 on the track of the loop belt 291. Further, the belt transporter 290 can switch the pressure supplied from the suction chamber 293 to the holes 294 in accordance with an instruction from the controller 150. That is, it is possible to adsorb the surface 213 of the medium 210 to the loop belt 291 by supplying the negative pressure from the suction chamber 293 to the holes 294, and it is possible to be released the surface 213 of the medium 210 by supplying the positive pressure. In this way, with the surface 213 of the medium 210 sucked by the holes 294 of the belt transporter 290, the medium 210 is held and transported.

In the present embodiment, the contact portion 240 is configured to move the bundle of medium 210 stacked in the stacker 250 in both direction T(+) and the reverse direction T(−) of the processor 260. Then, the medium 210 transported by the belt transporter 290 and stacked in the stacker 250 is transported in the direction of the processor 260 by the contact portion 240 configured to move and is processed by the processor 260 in the same manner as in the first embodiment.

Other Embodiments

The medium processing device 200 according to the present disclosure is basically based on the configuration as described above, and the configuration can be partially modified or omitted without departing from the scope of the present disclosure.

For example, also in the first embodiment and the second embodiment, the contact portion 240 may be configured to move the bundle of medium 210 stacked in the stacker 250 in both direction T(+) and the reverse direction T(−) of the processor 260. When the bundle of medium 210 is carried to the processor 260, it becomes possible to carry the bundle of medium 210 in a stable state by moving the contact portion 240 together with the gripper 231 of the transporter 230.

It is possible to move the contact portion 240 in the direction of stacker 250 and in the direction of the transporter 230, using a rack and pinion mechanism, a belt and pulley mechanism, a guide and screw mechanism, and the like, for example.

Further, the contact portion 240 may include a movable second contact portion (not shown) that the rear end 212 of the medium 210 stacked in the stacker 250 can be brought into contact with.

What is claimed is:

1. A medium processing device comprising;
a supply portion supplying a medium;
a transporter transporting the medium supplied from the supply portion;
a contact portion with which a tip of the medium transported by the transporter in a transport direction is brought into contact;
a stacker on which the medium brought into contact with the contact portion is stacked; and
a processor processing the medium stacked in the stacker,
wherein the transporter includes a gripper configured to move in an extending direction of the stacker to grip the tip of the medium,
wherein the contact portion is secured to the stacker in a fixed position in relation to a lower end of the stacker, is separate from the transporter and the gripper, and includes a slit through which the transporter can pass,
wherein the transporter grips, by the gripper, the medium positioned in a range where a feeding force of the supply portion applies and moves the medium toward the contact portion, and
wherein when the transporter transports and stacks in the stacker the medium which is supplied from the supply portion, a region in which the transporter transports the medium does not overlap with a region in which the medium is stacked.

2. The medium processing device according to claim 1, wherein the stacker has a stacking surface on which the medium is stacked, and the stacking surface is configured to move in a normal direction of the stacking surface.

3. The medium processing device according to claim 2, wherein the stacking surface is configured to move in accordance with the number of mediums stacked in the stacker.

4. The medium processing device according to claim 1, wherein when the last medium is supplied from the supply portion, the transporter moves, together with a plurality of medium stacked in the stacker that comprise a medium bundle, to the range where the feeding force of the supply portion applies, grips, by the gripper, the entire medium bundle to which the last medium is added, and moves toward the contact portion.

5. The medium processing device according to claim 1, wherein the processing performed by the processor includes saddle stitching processing in which a center of the medium in the transport direction is stitched in a state where the medium is stacked in the stacker with the tips arranged and saddle folding processing in which the center of the medium is folded.

6. The medium processing device according to claim 5, wherein the medium stacked in the stacker is transported to the processor by the transporter and processing is performed.

7. The medium processing device according to claim 1, wherein the gripper grips only the medium which is supplied by the supply portion.

8. A medium processing device comprising;
a supply portion supplying a medium;
a transporter transporting the medium supplied from the supply portion;
a contact portion with which a tip of the medium transported by the transporter in a transport direction is brought into contact;
a stacker on which the medium brought into contact with the contact portion is stacked; and
a processor processing the medium stacked in the stacker,
wherein the transporter includes a gripper configured to move in an extending direction of the stacker to grip the tip of the medium,
wherein the contact portion is secured to the stacker and is separate from the transporter and the gripper,
wherein the transporter grips, by the gripper, the medium positioned in a range where a feeding force of the supply portion applies and the transporter moves the medium toward the contact portion, and
wherein when the last medium is supplied from the supply portion, the transporter moves, together with a plurality of medium stacked in the stacker that comprise a medium bundle, to the range where the feeding force of the supply portion applies, grips, by the gripper, the entire medium bundle to which the last medium is added, and moves toward the contact portion.

9. A medium processing device comprising;
a supply portion supplying a medium;
a transporter transporting the medium supplied from the supply portion;
a contact portion with which a tip of the medium transported by the transporter in a transport direction is brought into contact;
a stacker on which the medium brought into contact with the contact portion is stacked; and
a processor processing the medium stacked in the stacker,
wherein the transporter includes a gripper configured to move in an extending direction of the stacker to grip the tip of the medium,
wherein the contact portion is secured to the stacker and is separate from the transporter and the gripper,
wherein each time the medium is supplied by the supply portion, the transporter transports the medium toward the contact portion and stacks the medium on the stacker, and wherein the processing performed by the processor includes saddle stitching processing in which a center of the medium in the transport direction is stitched in a state where the medium is stacked in the stacker with the tips arranged and saddle folding processing in which the center of the medium is folded.

* * * * *